US005205456A

United States Patent [19]

Ohuchi et al.

[11] Patent Number: 5,205,456

[45] Date of Patent: Apr. 27, 1993

[54] BLIND RIVETTING GUN WITH AUTOMATIC LOADER

[76] Inventors: Masatoshi Ohuchi, 6-12, Shizuka-machi, Kooriyama-shi, Fukushima-ken; Masaru Matsumoto, 1-10-11, Narusegaoka, Machida-shi, Tokyo, both of Japan

[21] Appl. No.: 710,022

[22] Filed: Jun. 5, 1991

[30] Foreign Application Priority Data

Jun. 5, 1990 [JP] Japan ..... 2-146850

[51] Int. Cl.[5] ..... B21J 15/20

[52] U.S. Cl. ..... 227/57; 227/113; 227/120; 227/130; 29/243.523; 29/243.525

[58] Field of Search ..... 227/51, 53, 55, 57, 227/54, 61, 30, 120, 130, 113; 29/243.521-243.525

[56] References Cited

U.S. PATENT DOCUMENTS

| | | | |
|---|---|---|---|
| 3,157,305 | 11/1964 | Baugh | 29/243.521 |
| 3,277,689 | 10/1966 | Anthony | 29/243.522 |
| 3,367,166 | 2/1968 | Newton et al. | 29/243.523 |
| 3,733,882 | 5/1973 | Klein | 29/243.524 |
| 3,886,783 | 6/1975 | Hirsch | 29/243.523 |
| 4,248,077 | 2/1981 | Gregory | 29/243.524 |
| 4,454,746 | 6/1984 | Schwab | 29/243.525 |
| 4,604,889 | 8/1986 | Sukharevsky | 29/243.525 |
| 4,704,888 | 11/1987 | Frearson | 29/243.525 |

*Primary Examiner*—Frank T. Yost
*Assistant Examiner*—Scott A. Smith

[57] ABSTRACT

A blind rivetting gun provided with an automatic loader which enables a rivetting operation by only pulling a trigger wherein a loading operation of blind rivets in feed belt into a housing therein is executed by the automatic loader working intermittently when a blind rivet securing jaw is released and at the top dead point.

4 Claims, 8 Drawing Sheets

BLIND RIVETTING GUN WITH AUTOMATIC LOADER

BACKGROUND OF THE INVENTION

The present invention relates to a blind rivetting gun for rivetting sheet metals or the like by using blind rivets in a feed belt.

In a conventional rivetting gun, for example, disclosed by the Japanese Patent Application Laid-open No. 61-78526, it is necessary to feed rivets one by one through a nose piece of rivetting gun and take out the remaining rods of blind rivets one by one upward.

Accordingly, it is troublesome to load a blind rivet for each rivetting operation and it causes a drop of productivity. Remaining rods taken out of the rivetting gun are dispersed on the floor causing a lack of safety for operators.

BRIEF DESCRIPTION OF THE INVENTION

In order to carry out the above object, a blind rivetting gun according to the present invention comprises a head section, a hydro-pneumatic driving section and a rivet loader section.

The head section comprises a housing provided with a pair of clamps which can be opened to the front and are always closed by springs, a jaw release cylinder connected to an upper end of the housing, a jaw release piston connected with a jaw release cylinder, a hydro-pneumatic cylinder for pulling a rivet rod up which is connected to an upper end of the jaw release cylinder, a hydro-pneumatic piston integrally connected with a cylinder portion which is inserted in the jaw release cylinder, a pushing rod slidably inserted in the cylinder portion of the hydro-pneumatic piston and always pushed downward by springs provided in the cylinder portion, a cylindrical jaw case slidably inserted into the jaw release cylinder and having a tapered portion at the lower end and a hole on the lower end, and a pair of jaws always pushed downward by springs.

The hydro-pneumatic driving section comprises a pneumatic cylinder having a piston therein, a hydraulic cylinder integrally connected to a piston rod of the pneumatic cylinder and supplying hydraulic oil into an oil chamber of the hydro-pneumatic cylinder, an air valve supplying compressed air to a rear end of the pneumatic piston and another valve supplying compressed air to an upper portion of the hydro-pneumatic cylinder.

The rivet loader section is provided with a rivet loader guide loading blind rivets in a feed belt into the housing when the jaw releasing cylinder is at the top dead point. A lower port provided on the lower portion of the jaw release cylinder is connected to the left side of the pneumatic piston of the drive section. An upper port provided on the upper portion of the jaw release cylinder is connected to an air cylinder loading a feed belt.

When the trigger is not pulled, the open jaws descend and the upper point of a rivet rod enters into the gap of jaws. The jaws continue to descend being pushed by the pushing rod, then a rear end of the rivet protrudes through the clamps.

After inserting the rear end of the rivet into metallic sheets or the like, when the trigger is pulled, the push rod and the jaw case go up. The jaws secure the rivet rod and pull up the rivet, completing a rivetting operation. Then, the rivet rod is pulled off.

The jaw release cylinder continues to go up to release the jaws and the rivet rod remains on the feed belt.

DETAILED DESCRIPTION OF THE INVENTION

Figure 1:
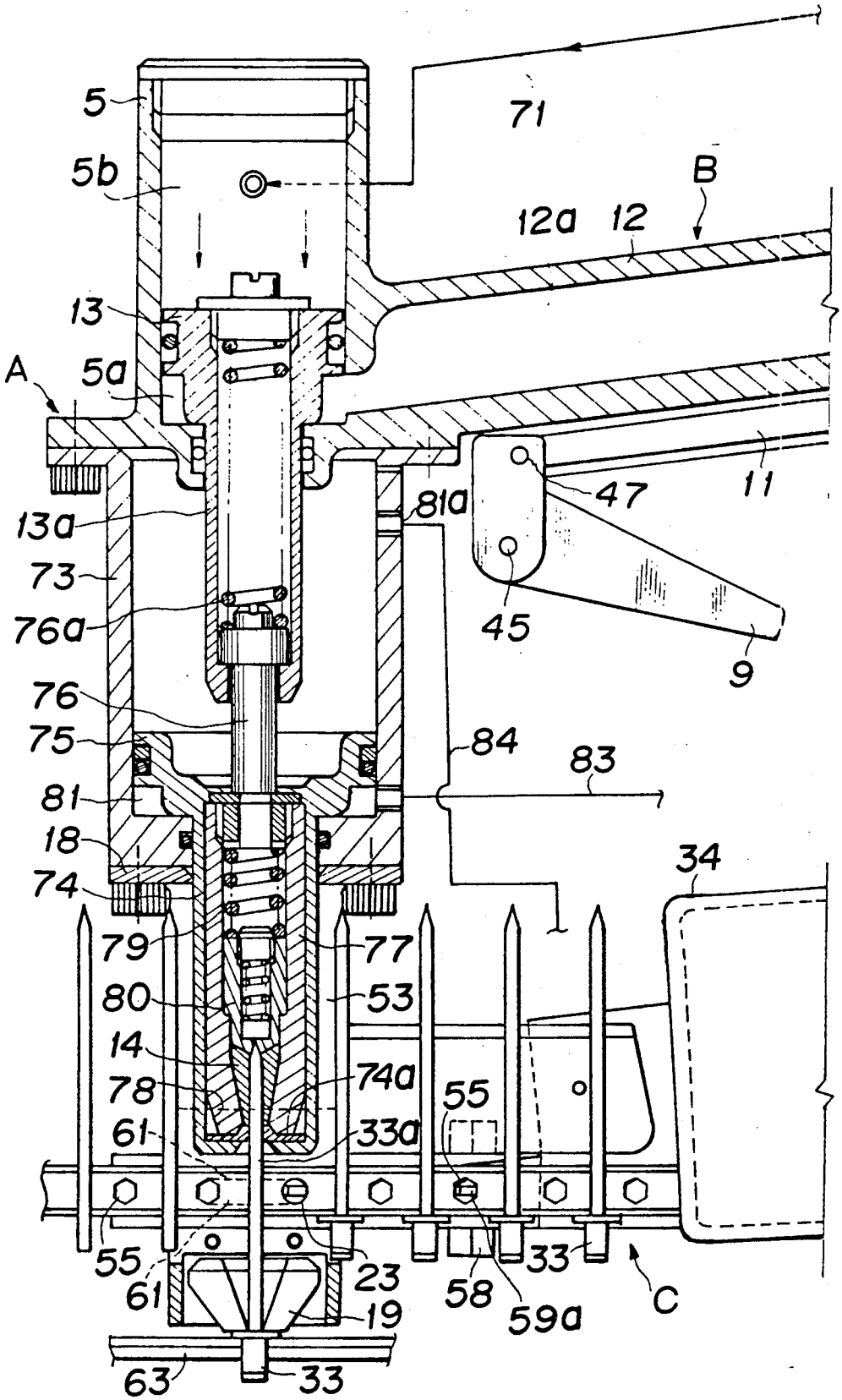
FIG. 1 shows a head section and a loader section in a phase of an embodiment according to the present invention.

Hereinafter, an embodiment according to the present invention will be described referring to the drawings. An integral drawing of a blind rivetting gun with an automatic loader is shown in separate FIGS. 1 and 2 due to the large scale thereof, wherein a trigger is released. The blind rivetting gun with an automatic loader comprises a housing A, a hydro-pneumatic driving section B and a rivet loader section C.

The hydro-pneumatic driving section B comprises a pneumatic cylinder 1 having a piston 2 therein, a hydraulic cylinder 12 integrally connected to a piston rod 3 therein of the pneumatic cylinder 1 and supplying hydraulic oil into an oil chamber 12*a* of the hydro-pneumatic cylinder 1 and 12, an air valve 44 supplying compressed air to the rear end (right side of the piston 2), of which port 40 is to be connected to an compressed air source (not shown), and a plug 70 closing a through hole 41. Both valves are connected with a rod 6 which is pushed to the left by a spring 25.

A trigger 9 and an arm 10 are pivoted with pins 45 and 46 respectively on the lower portion of the hydraulic cylinder 12 and articulated with a rod 11 so that, when the trigger 9 is pulled, the arm 10 pushes the rod 6 to the right.

Figure 9:
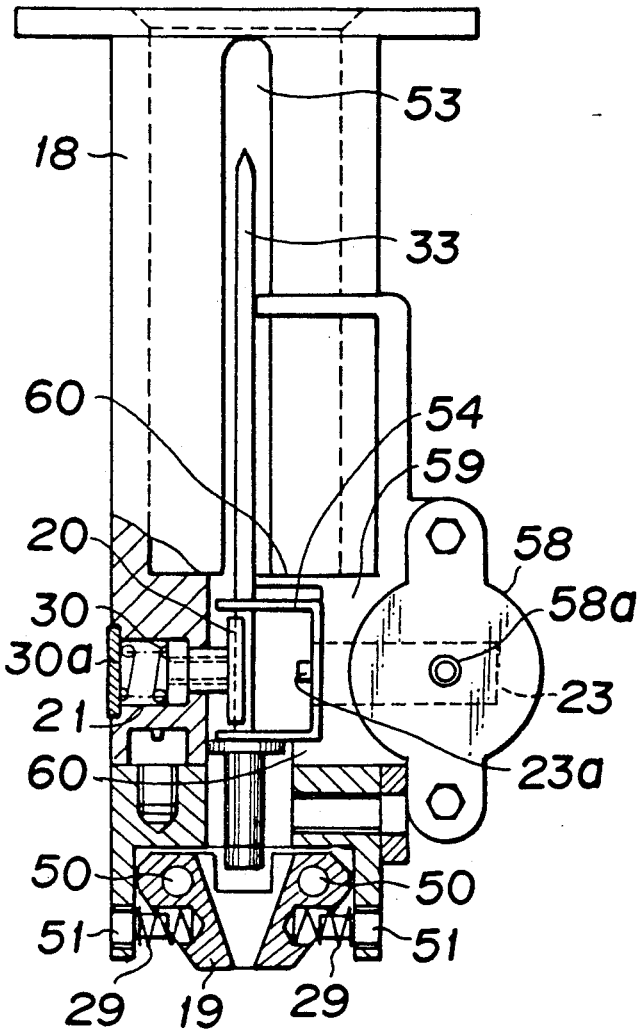
FIG. 9 shows a side view of a housing.
Figure 10:
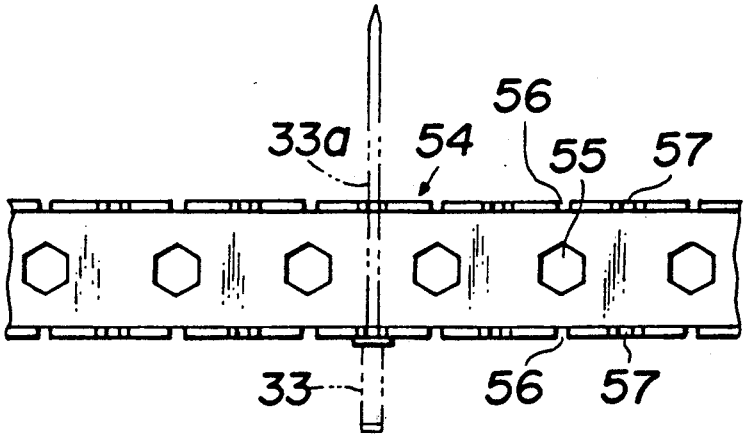
FIG. 10 shows a front view of a feed belt of rivet used in an embodiment according to the present invention.
Figure 11:
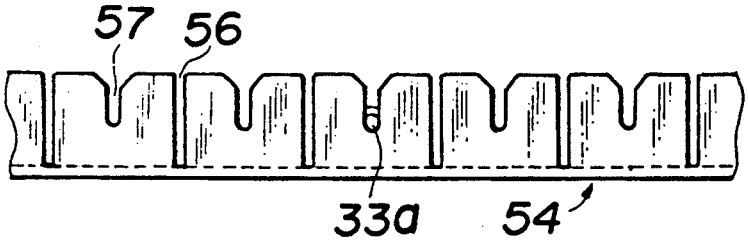
FIG. 11 shows a plan view of the feed belt in FIG. 10.
Figure 12:
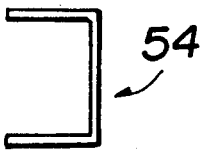
FIG. 12 shows a side view of the feed belt in FIG. 10.
Figure 13:
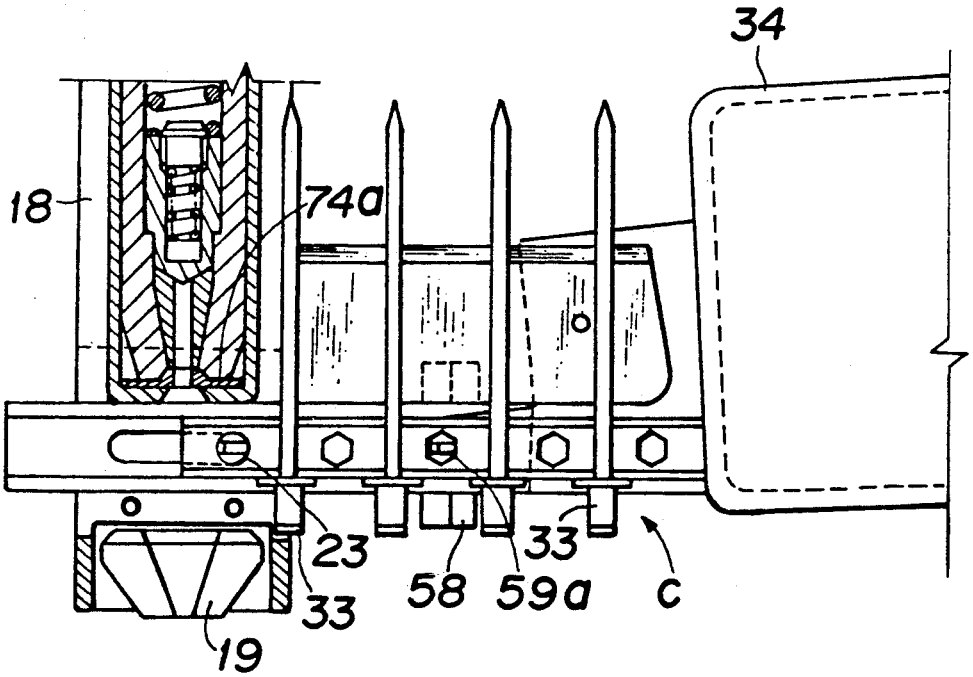
FIG. 13 shows a loader section.

The head section A comprises a housing 53 provided with a pair of clamps 19 pivoted on the housing 53 and springing to close a front end thereof (lower end in FIG. 9), which can be opened to the front when a rivet passes through, a jaw release pneumatic cylinder 73 connected to an upper end of the housing 53, a jaw release piston 75 connected with a jaw release cylinder, a hydro-pneumatic cylinder 5 connected to an upper end of the jaw release cylinder 73, a hydro-pneumatic piston 13 for pulling up a rivet rod which is integrally connected with a cylinder portion 13*a* inserted into the jaw release cylinder 73, a pushing rod 76 slidably inserted into the cylinder portion 13*a* of the hydro-pneumatic piston 13 and always pushed downward by a spring 76*a* provided in the cylinder portion 13 and a cylindrical jaw case slidably inserted into the jaw release cylinder 74 and having a tapered portion 78 at the lower end, wherein a pair of jaws 14 are always pushed downward by springs 79 through a jaw pusher 80.

The rivet loader section C is provided with a rivet loader guide 59 loading rivets in a feed belt into the housing 53 when the jaw releasing cylinder 74 is at the top dead point. A lower port 81 provided on the lower portion of the jaw release cylinder 74 is connected to the left side of the pneumatic piston 2 of the hydro-pneumatic driving section B. An upper port 81*a* provided on the upper portion of the jaw release cylinder 74 is connected to an air cylinder 58 loading a feed belt 54.

When the trigger 9 is in released position (not pulled), the open jaws 14 descend and the upper point of rivet rod 33*a* enters into the gap of jaws 9. The jaws 9 continue to descend being pushed by the pushing rod 76, then a rear end of rivet 33 protrudes through the clamps 19.

The feed belt of rivet 54 is made of polypropyrene or the like in a channel form and has slits 56 on the edges thereof and hexagonal holes 55 for advancing the belt 54.

In the rivet loader section C, a piston 22 energized by a spring 31 is provided in the air cylinder 58, wherein a claw 23*a* is provided on a shaft 23 to advance a feed belt. The shaft 23 is fixed with pin 23*a*. The air cylinder 58 is connected with the upper port 81*a* of pneumatic jaw release cylinder 73. An air port 58*a* is connected to the upper port 81*a* with a tube 84.

The rivet guide 59 is of channel form having edges 60 and has slot 61 wherein the claw 23 reciprocates front and back. Numeral 20 indicates a suppressor always suppressing a feed belt on the guide 59, which is pressed outwardly by springs 30 secured on the guide 59 by plates 30*a*. Numeral 34 indicate a cylindrical case for a feed belt of rivet, which is fixed perpendicularly on the rivet guide 59. When the claw 23 works, a feed belt in the case 34 is pulled out along the channel portion of the rivet guide 59.

Hereinafter, a function of the blind rivetting gun according to the present invention will be described.

Figure 2:
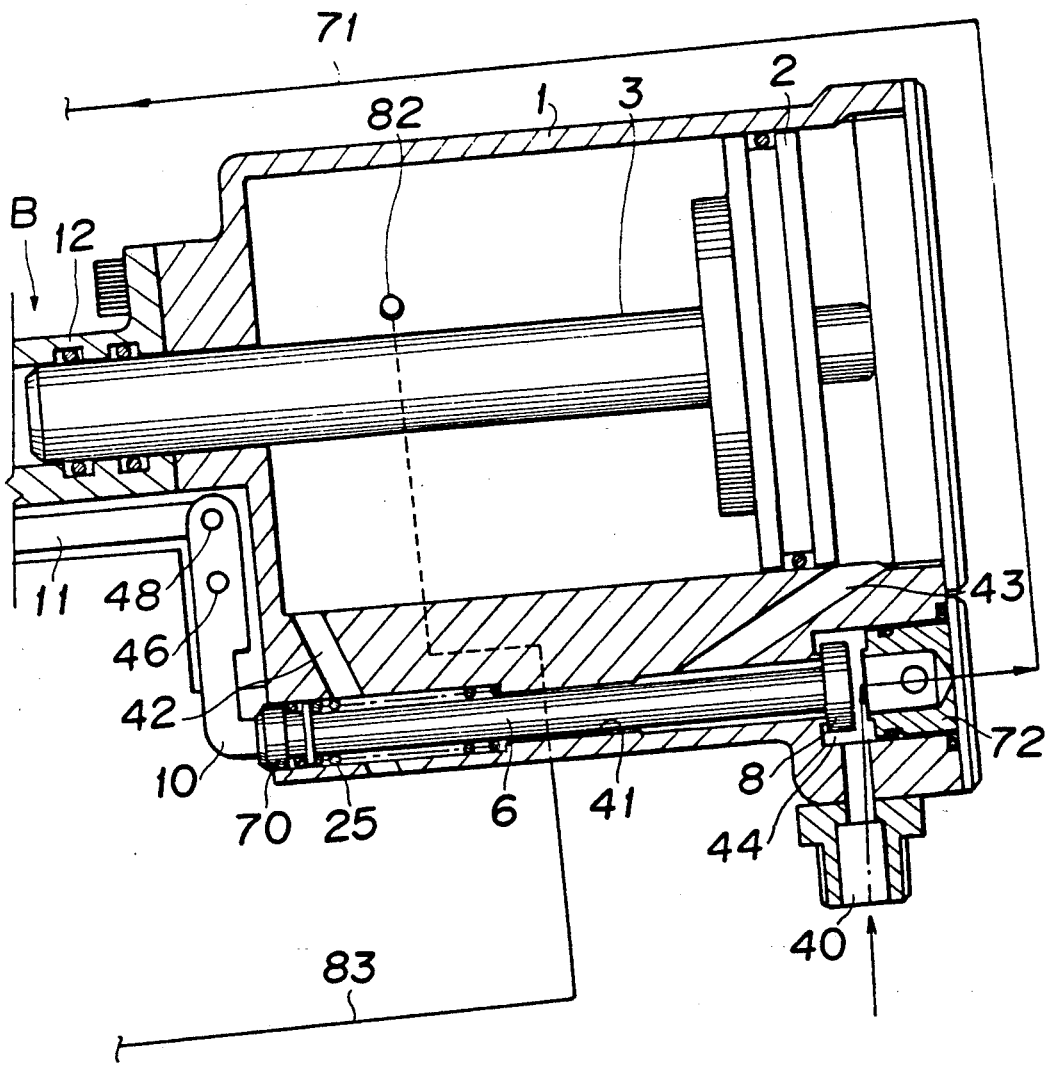
FIG. 2 shows a driving section of the embodiment.
Figure 3:
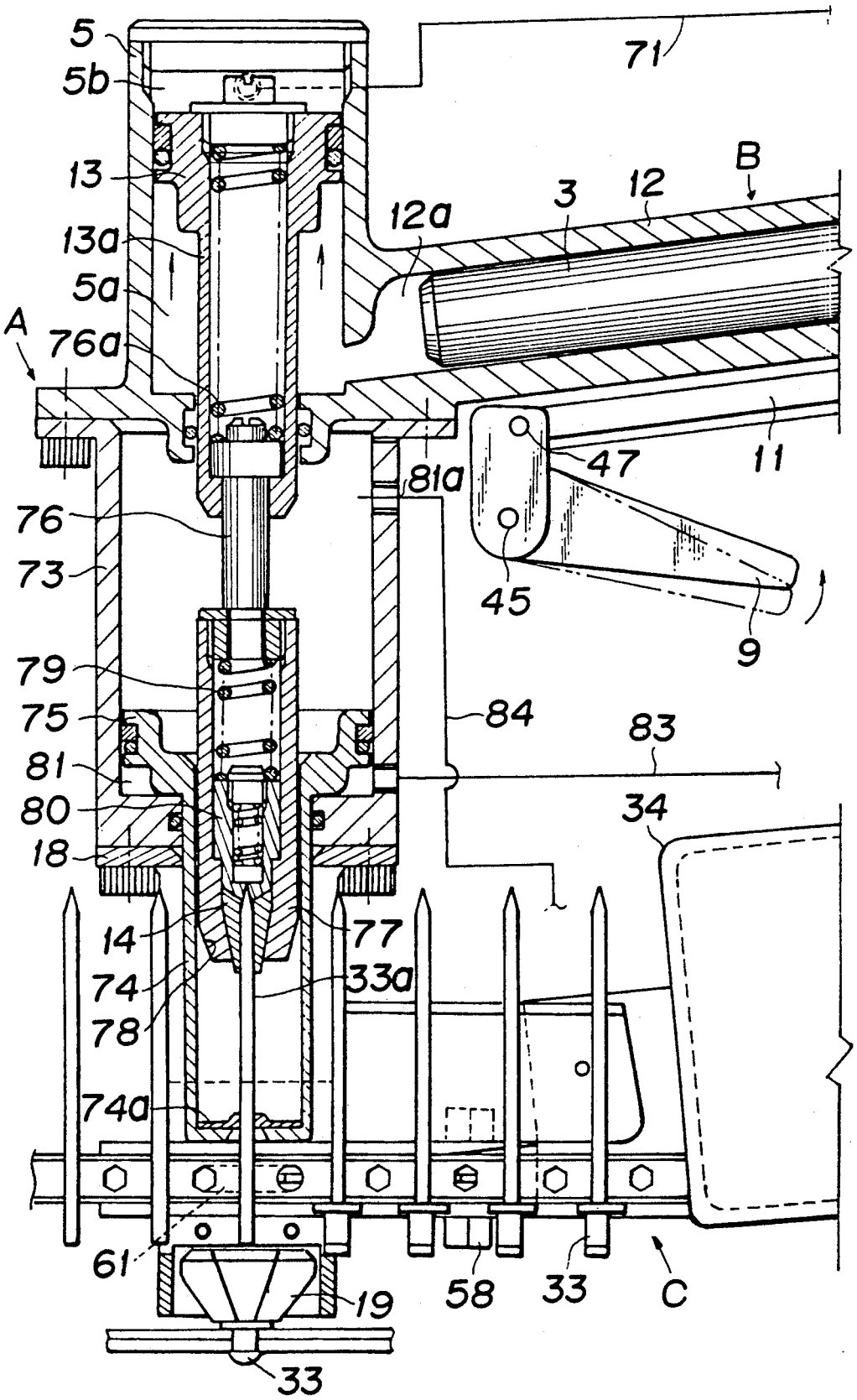
FIG. 3 shows the head section in another phase.

Normally, the blind rivetting gun is loaded with a feed belt with rivets in the case 34 as shown in FIG. 1, then the trigger is in free position and a rear end of blind rivet 33 is protruded out of the clamps 19.

After connecting the air port 40 to a compressed air source (not shown), the rear end of the rivet 33 is inserted into holes formed on metallic sheets 63. When the trigger 59 is pulled, the valve 8 is open and compressed air enters into the rear end of the piston 2 of the pneumatic cylinder 1. The piston 2 is advanced to push oil into an oil chamber 5*a* pushing the piston 13 up to the highest position.

Then, the pushing rod 76 and the jaw case 77 go up and the jaws 14 protrude downward sliding on the inner tapered portion 78, because the jaws 14 are pushed downward by the push rod 76 through the spring 79. Accordingly, the jaws 14 secure the rivet rod 33*a* and continue to pull up. And, finally the rivet rod 33*a* is torn off by the lower ends of the clamps completing the rivetting operation.

Figure 5:
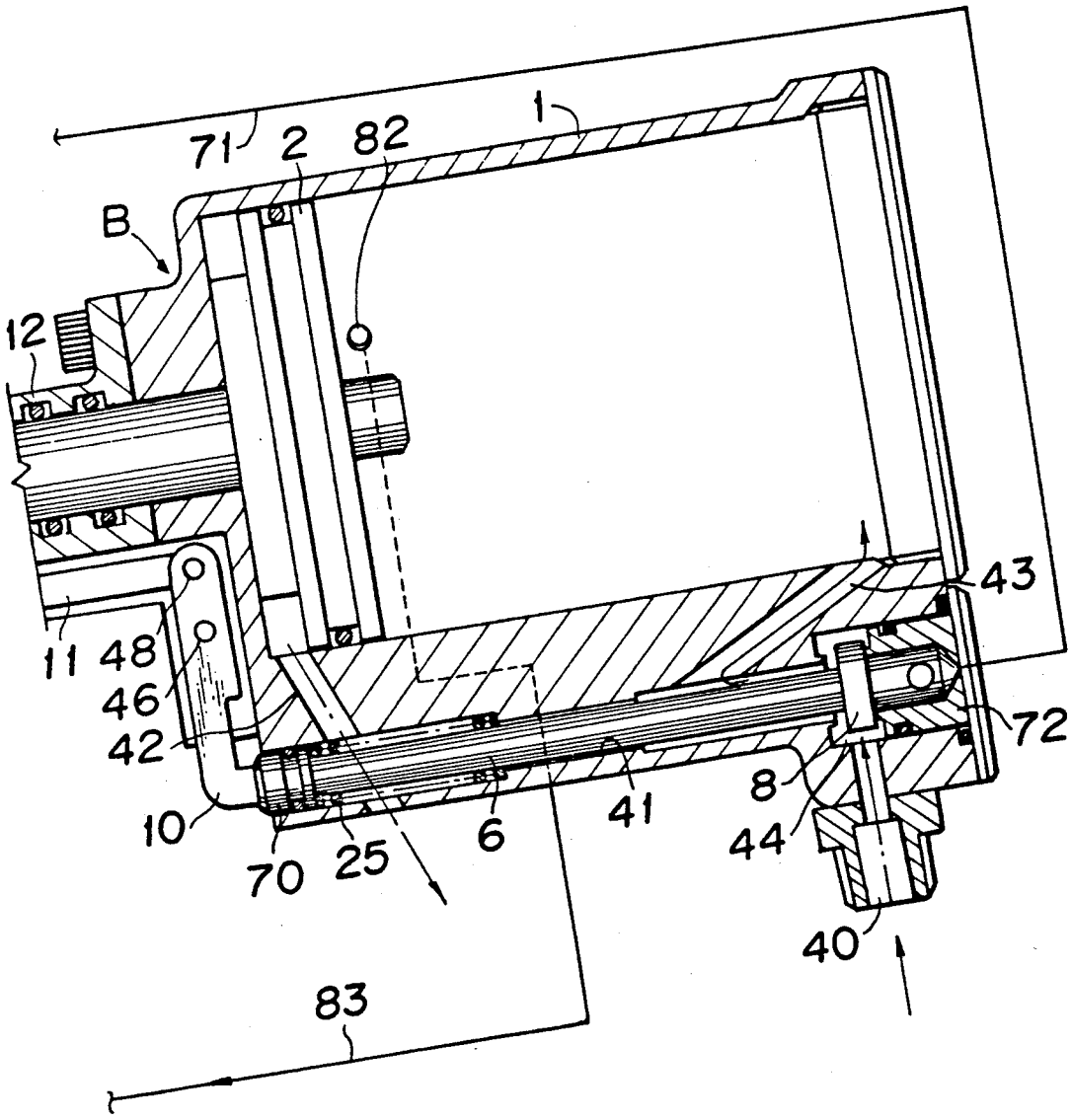
FIG. 5 shows the driving section in another phase.
Figure 6:
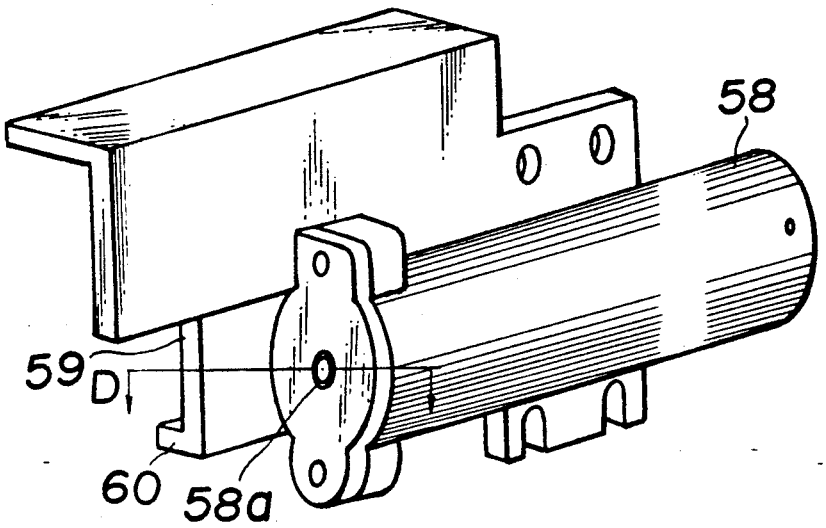
FIG. 6 shows a loader guide.
Figure 7:
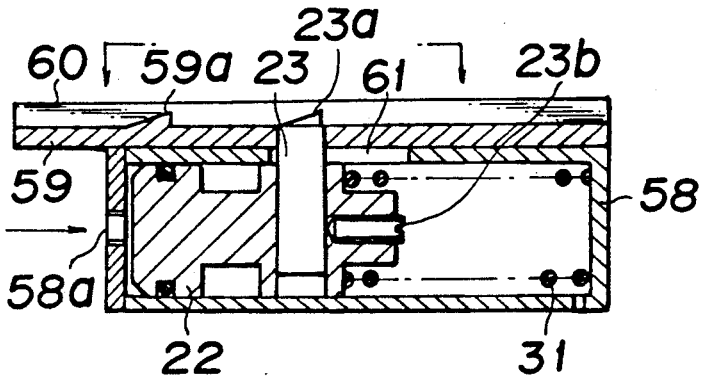
FIG. 7 shows a sectional view along line D—D in FIG. 6.
Figure 8:
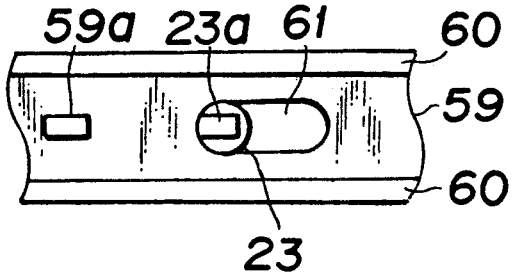
FIG. 8 shows a front view of a guide plate.

When the advance of piston 2 is terminated as shown in FIG. 5, compressed air in the air cylinder 1 is transmitted to the air chamber 81 of the jaw releasing cylinder 73 through the air port 82 and the tube 83.

Then, the jaw release piston 75 and the jaw release cylinder 74 are elevated, accordingly a release washer 74*a* on the bottom of the jaw release cylinder 74 abuts on the lower ends of jaws 14 and opens the jaws 14.

Figure 4:
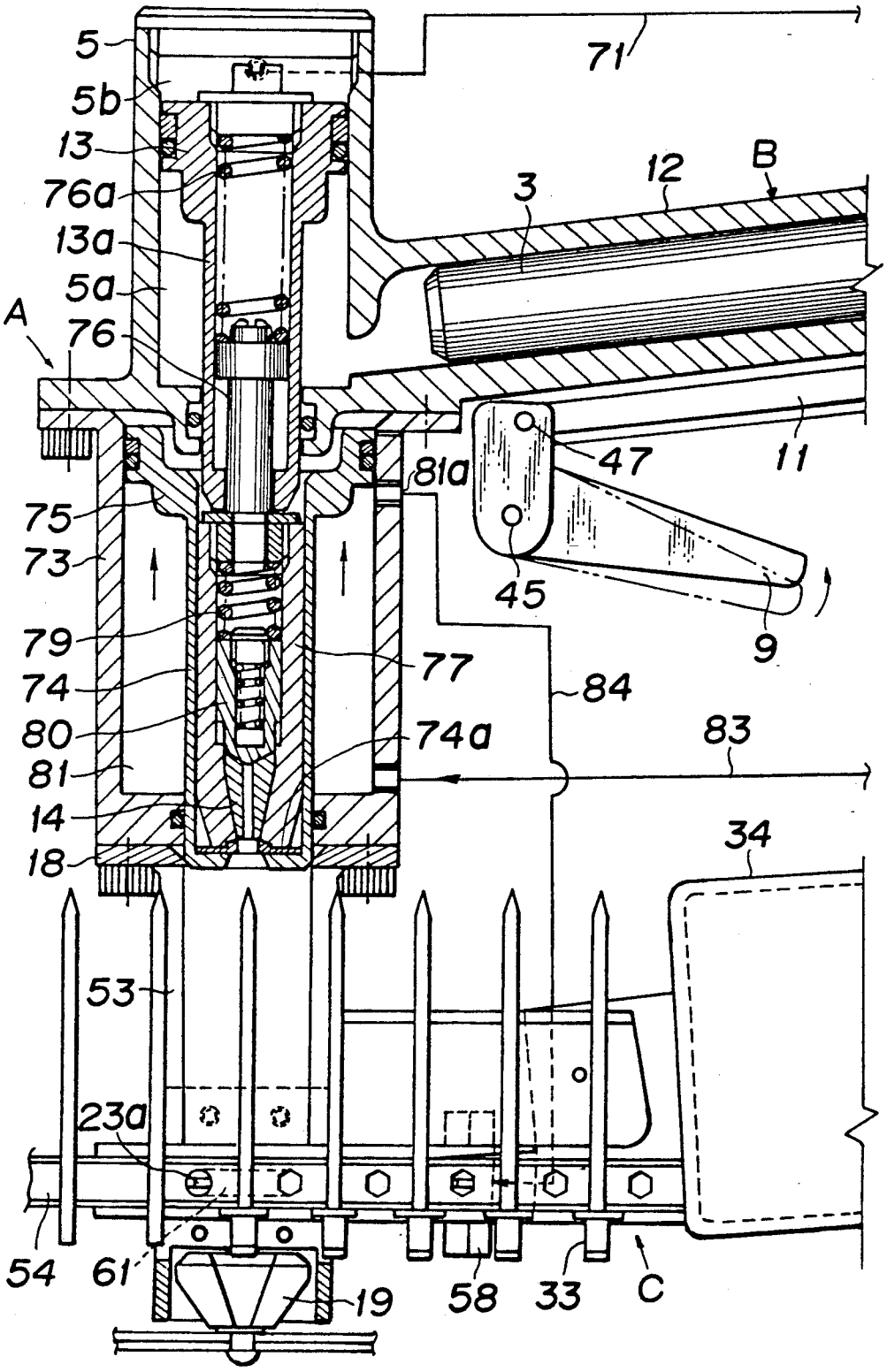
FIG. 4 shows the head section in other phase.

The jaw release cylinder 74 continues to go up compressing the spring 76*a* and obtains a position shown in FIG. 4.

When the jaw release piston 75 reaches the top dead point, compressed air feed through the lower port 83 is transmitted to the air cylinder 58 through the upper air port 81*a*, the tube 84 and the port 58*a*. Then, the piston 22 is pushed to the right advancing the claw 23*a* compressing the spring 31, completing a feeding operation of feed belt. Accordingly, another blind rivet is loaded into the rivetting position along the edges 60 as shown in FIG. 4.

When the trigger 9 is released, the valve 8 is closed by the spring 25 and compressed air is fed into an air chamber 5*b* of the hydro-pneumatic cylinder 5 through an air chamber 72 and a tube 71. Then, the pushing rod 76, the jaw case 77, the piston 13, the jaw release piston 75 and the jaw release cylinder 74 are pushed down to the bottom dead point. The upper point of blind rivet placed in position enters into the gap of edges 14 and is pushed down by the pushing rod 76, then the rear end of blind rivet protrudes from the clamps 19. Then, compressed air supply to the air cylinder 58 is stopped and the piston 22 returns to the former position (to the left) by the spring 31. However, the retractive motion of the feed belt is restrained by the pawl 59*a*, then the claw 23*a* returns to the former position disengaging from the hole 55 and engages with the next hole.

By repeating the above operation, a rivetting operation can be realized continuously.

Also, rivet rods torn off and secured in the belt are exhausted through the housing 53.

When a new feed belt 54 is loaded into the case 34 positioning a hole 55 on the claw 23*a* of the guide plate 59 and the trigger 9 is pulled to push up the hydro-pneumatic piston 13 and the jaw release piston 75, a first blind rivet 33 is loaded into the housing 53. Then, the jaw releasing cylinder 74 is in the position shown in FIG. 4.

When the trigger is released, the hydro-pneumatic piston 13 and the jaw releasing piston 74 descend as shown in FIG. 1, and a rear end of blind rivet is protruded through the clamps 19 completing a preparation of rivetting operation.

As described above, a blind rivetting gun according to the present invention improves a productivity of rivetting operation because rivets in feed belt are loaded automatically, and prevents scattering of used rivet rods on the floor.

What is claimed is:

1. A blind rivetting gun comprising a head section, a hydro-pneumatic driving section and a rivet loader section, said head section including:

a rivet clamping portion including:

a housing having a vertical slit for allowing blind rivets to pass in a feed belt, and a pair of clamps pivoted on a lower portion thereof which are openable to a front and normally closed by a pair of springs;

a rivet rod securing portion including:

a pneumatic jaw release cylinder connected to an upper end of said housing and having an upper air port and a lower air port, a jaw release piston slidably inserted into said pneumatic jaw release cylinder and having a jaw release cylinder integrally connected to a lower end thereof which is provided with a through hole on a bottom thereof for receiving a rivet rod, and a cylindrical jaw case slidably supported in said jaw release cylinder by a pushing rod and provided with an inner tapered portion to a front, wherein a pair of jaws are normally pushed downward by springs inserted therein; and a jaw pulling up portion.

2. The gun of claim 1, wherein said jaw pulling up portion includes:

a hydro-pneumatic cylinder having an upper air port, connected to an upper end of said pneumatic jaw release cylinder and integrally connected with a hydro-pneumatic driving section so as to receive a hydraulic pressure through a lower port therein; and a hydro-pneumatic piston slidably inserted into said hydro-pneumatic cylinder and integrally connected to a vertical cylinder having a through hole on the bottom thereof, wherein said pushing rod connected to said jaw case is slidably inserted into said through hole and always pushed downward by a spring inserted into said vertical cylinder and secured by a screw.

3. The gun of claim 2, wherein said hydro-pneumatic driving section includes:

a hydraulic cylinder of which front end is connected to said hydro-pneumatic cylinder and rear end is connected to a pneumatic cylinder, said pneumatic cylinder having a pneumatic piston therein and a third air port and an air release port at a front end of said pneumatic cylinder and a fourth air port at a rear end of said pneumatic cylinder;

a piston rod connected to said pneumatic piston and inserted into said hydraulic cylinder and said pneumatic cylinder, respectively;

an air valve supplying compressed air introduced through said fourth air port into said rear end of said pneumatic cylinder;

a trigger pivoted to one end of a first rod on a lower portion of said hydraulic cylinder; and an arm pivoted at one end to the another end of said first rod and the other end of said arm abuts one end of a second rod on a lower portion of said pneumatic cylinder, the other end of said second rod connecting to said air valve.

4. The gun of claim 1, wherein said rivet loader section includes:

a rivet loader guide fixed transversely on a side of said housing; and a pneumatic cylinder connected to said upper air port of said pneumatic jaw release cylinder and a piston provided with a claw for advancing a rivet feed belt when said jaw release cylinder is on a top dead point, wherein said claw reciprocates in a slot of a guide plate provided on said loader guide.

* * * * *